US009637332B2

(12) United States Patent
Tanaka et al.

(10) Patent No.: US 9,637,332 B2
(45) Date of Patent: May 2, 2017

(54) SHEET FEEDING CASSETTE AND IMAGE FORMING APPARATUS INCLUDING THE SAME

(71) Applicant: KYOCERA Document Solutions Inc., Osaka (JP)

(72) Inventors: Hiroyuki Tanaka, Osaka (JP); Motoyuki Fukuda, Osaka (JP); Tetsuya Ichiguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/939,527

(22) Filed: Nov. 12, 2015

(65) Prior Publication Data

US 2016/0167901 A1 Jun. 16, 2016

(30) Foreign Application Priority Data

Dec. 10, 2014 (JP) ..... 2014-250175

(51) Int. Cl.
*B65H 1/04* (2006.01)
*B65H 1/26* (2006.01)
*G03G 15/00* (2006.01)

(52) U.S. Cl.
CPC ..... *B65H 1/266* (2013.01); *B65H 1/04* (2013.01); *G03G 15/6502* (2013.01); *B65H 2405/112* (2013.01); *B65H 2405/115* (2013.01); *B65H 2551/20* (2013.01)

(58) Field of Classification Search
CPC . B65H 1/04; B65H 1/00; B65H 1/266; B65H 7/04; B65H 13/103; B65H 2405/31; G03G 15/6502
See application file for complete search history.

(56) References Cited

U.S. PATENT DOCUMENTS 7,848,676 B2 * 12/2010 Akiyama ..... G03G 15/6502 399/107
2004/0041329 A1 * 3/2004 Hiraoka ..... B65H 7/04 271/110
2006/0008292 A1 * 1/2006 Watanabe ..... G03G 15/6552 399/107

FOREIGN PATENT DOCUMENTS

JP 05032353 A * 2/1993
JP H 9-2672 A 1/1997
JP H 11-11743 A 1/1999
JP 11147620 A * 6/1999
JP 2000-238918 A 9/2000
JP 2000281221 A * 10/2000
JP 2001310830 A * 11/2001
JP 2006052077 A * 2/2006

* cited by examiner

*Primary Examiner* — Luis A Gonzalez
(74) *Attorney, Agent, or Firm* — Stein IP, LLC

(57) ABSTRACT

A sheet feeding cassette includes a storage region, a front portion, and a bottom portion. On the storage region, a sheet is stored. The front portion is disposed on a downstream side with respect to the storage region in a drawing direction. On the bottom portion, the sheet is placed. In the front portion, an opening is formed through which the storage region is visible. Within the storage region, the bottom portion is formed in white or a pale color. At least a part of the visible region in the storage region is formed to be different in lightness by three or more in Munsell value from a light-color part of the bottom portion, the light-color part being formed in white or the pale color.

15 Claims, 8 Drawing Sheets

SHEET FEEDING CASSETTE AND IMAGE FORMING APPARATUS INCLUDING THE SAME

INCORPORATION BY REFERENCE

This application is based upon and claims the benefit of priority from the corresponding Japanese Patent Application No. 2014-250175 filed on Dec. 10, 2014, the entire contents of which are incorporated herein by reference.

BACKGROUND

The present disclosure relates to a sheet feeding cassette in which a recording medium such as a sheet is stored and that is used in image forming apparatuses such as digital copiers and laser printers, and an image forming apparatus including such a sheet feeding cassette.

Conventionally, there have been widely used sheet feeding cassettes in which sheets are stackedly stored and from which the sheets are fed to an image forming portion in the main body of an image forming apparatus during an image forming operation.

For example, there is known an image forming apparatus configured such that a window is provided in the front portion of a sheet feeding cassette and a two-color LED is disposed in the main body of the apparatus so that the two-color LED is visible through the window of the sheet feeding cassette with the sheet feeding cassette loaded in the main body of the apparatus. In such an image forming apparatus, the two-color LED emits yellow light when the sheet feeding cassette is running out of sheets, and red light when the sheet feeding cassette has run out of sheets, and this makes it possible to confirm the presence/absence of a sheet by seeing the two-color LED even with the sheet feeding cassette loaded in the main body of the apparatus.

Furthermore, there is known an image forming apparatus configured such that a viewing window is provided in a front portion of a sheet feeding tray (sheet feeding cassette), whereby it is possible to confirm the presence/absence of a sheet even with the sheet feeding tray loaded in the main body of the apparatus.

SUMMARY

According to a first aspect of the present disclosure, a sheet feeding cassette is a sheet feeding cassette that is insertable and drawable with respect to an apparatus main body of an image forming apparatus, and includes a storage region, a front portion, and a bottom portion. The storage region is a region on which a sheet is stored. The front portion is disposed on a downstream side with respect to the storage region in a drawing direction, and constitutes a part of an exterior surface of the image forming apparatus. The bottom portion is a part on which the sheet is placed. In the front portion, there is formed an opening through which the storage region is visible. Within the storage region, the bottom portion is formed in white or a pale color. At least a part of a visible region in the storage region, the visible region being visible through the opening, or at least a part of a visible member disposed on the visible region, is formed to be different in lightness by three or more in Munsell value from a light-color part of the bottom portion, the light-color part being formed in white or the pale color.

According to a second aspect of the present disclosure, a sheet feeding cassette is insertable and drawable with respect to an apparatus main body of an image forming apparatus, and includes a storage region, a front portion, and a bottom portion. The storage region is a region on which a sheet is stored. The front portion is disposed on a downstream side of the storage region in a drawing direction, and constitutes a part of an exterior surface of the image forming apparatus. The bottom portion is a part on which the sheet is placed. In the front portion, there is formed an opening through which the storage region is visible. Within the storage region, the bottom portion is formed in white or a pale color. Within a visible region in the storage region, the visible region being visible through the opening, a through hole is formed at least in a part of the bottom portion.

According to a third aspect of the present disclosure, a sheet feeding cassette is insertable and drawable with respect to an apparatus main body of an image forming apparatus, and includes a storage region, a front portion, and a bottom portion. The storage region is a region on which a sheet is stored. The front portion is disposed on a downstream side of the storage region in a drawing direction, and constitutes a part of an exterior surface of the image forming apparatus. The bottom portion is a part on which the sheet is placed. In the front portion, there is formed an opening through which the storage region is visible. Within the storage region, the bottom portion is formed in white or a pale color. Texturing or knurling is applied to at least a part of a visible region in the storage region or at least a part of a visible member disposed on the visible region, the visible region being visible through the opening.

Still other objects and specific advantages of the present disclosure will become apparent from the following descriptions of embodiments.

DETAILED DESCRIPTION

Figure 1:
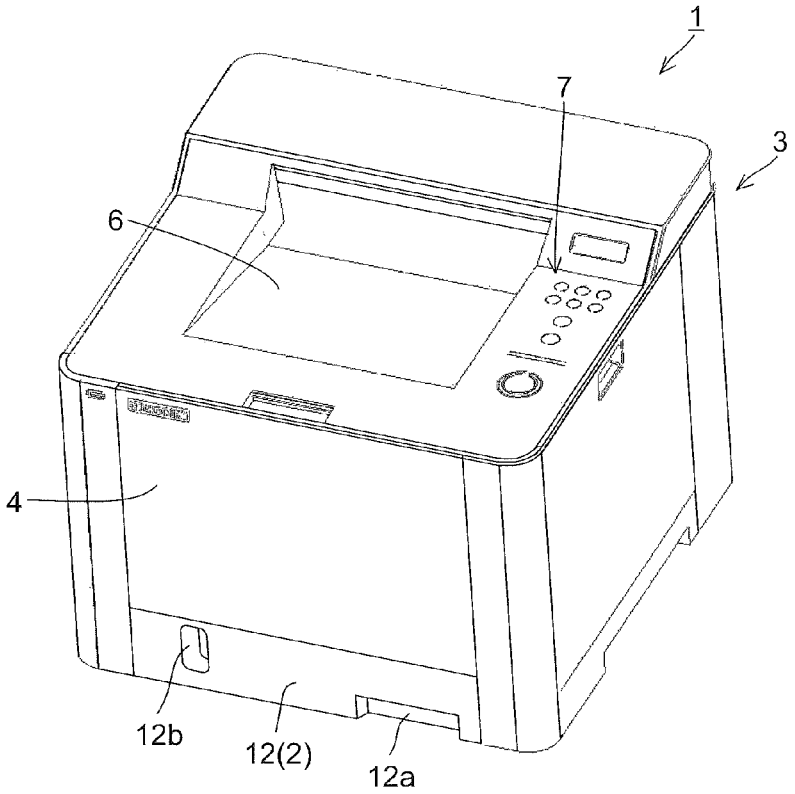
FIG. 1 is a perspective view illustrating a structure of an image forming apparatus including a sheet feeding cassette of a first embodiment of the present disclosure.

Hereinafter, embodiments of the present disclosure will be described with reference to the accompanying drawings.

First Embodiment

With reference to FIG. 1 to FIG. 6, a description will now be given of an image forming apparatus 1 including a sheet feeding cassette 2 according to a first embodiment of the present disclosure. As illustrated in an FIG. 1, the image forming apparatus 1 includes an apparatus main body 3 having a substantially hexahedron structure. At a forward portion of the apparatus main body 3, which a user is to stand facing when operating the image forming apparatus 1, there are provided a front cover 4 and a sheet feeding cassette 2. The front cover 4 is attached openable and closable with respect to the apparatus main body 3, and functions as a manually feeding tray when opened. The sheet feeding cassette 2 is loadable and unloadable with respect to the apparatus main body 3. At an upper part of the apparatus main body 3, there are provided a delivery tray 6 to which a sheet is delivered, and an operation portion 7 including a plurality of buttons and the like.

Inside the apparatus main body 3, there are provided an image forming section, a fixing section, a sheet conveyance path, etc., which are not illustrated. The image forming section transfers a toner image onto a fed sheet and forms an image on the fed sheet based on image data received from a terminal such as a personal computer. The image forming section includes components such as a photosensitive drum (an image carrier) that carries an electrostatic latent image, a charging unit that charges a surface of the photosensitive drum, an exposure unit that forms an electrostatic latent image corresponding to a document image on the surface of the photosensitive drum with a laser beam or the like, a developing device that forms a toner image by making a developer adhere to the formed electrostatic latent image, a transfer roller that transfers the toner image onto a sheet, and a cleaning blade that removes residual toner from the surface of the photosensitive drum. The fixing section applies heat and pressure to the sheet onto which the toner image has been transferred, and thereby fixes the toner image on the sheet.

Next, a configuration of the sheet feeding cassette 2 will be described. Unillustrated rail portions are provided on side faces of a cassette main body 10, and the rail portions are engaged with unillustrated rails provided inside the image forming apparatus 1, and this allows the sheet feeding cassette 2 to be horizontally slid in directions indicated by arrows AA' in FIG. 2 to be loaded and unloaded.

The cassette main body 10 is formed in a shape of a flat box having an open top face, and sheets are put into the cassette main body 10 from above, via the open top face to be stackedly stored in the cassette main body 10. The cassette main body 10 includes a bottom portion 11, a front portion 12, a back portion 13, and a pair of side portions 14, which are formed of resin integrally with each other. The front portion 12, the back portion 13, and the side portions 14 respectively stand from four edges of the bottom portion 11.

Figure 2:
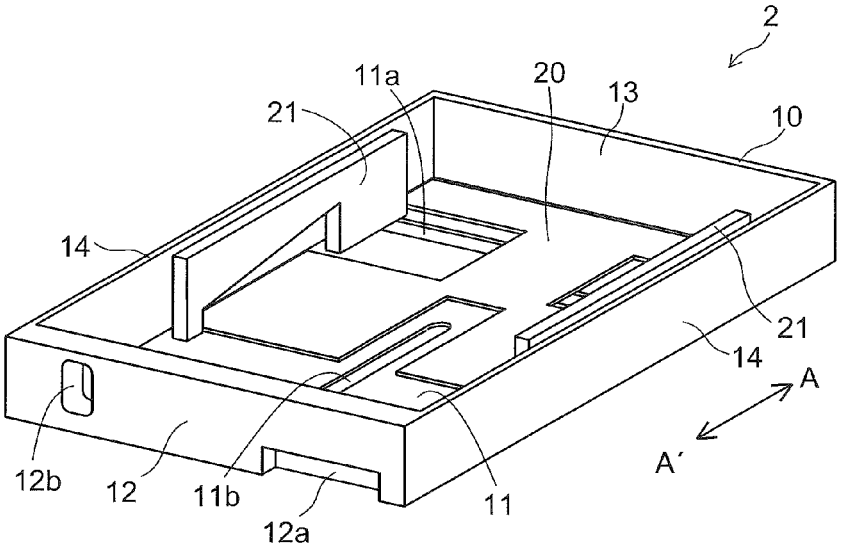
FIG. 2 is a perspective view illustrating a structure of the sheet feeding cassette of the first embodiment of the present disclosure.

Inside the image forming apparatus 1, above the back portion 13 that is located on a downstream side of the cassette main body 10 in an insertion direction, there is disposed a sheet feeding device (not shown), and a sheet is supplied in the arrow A direction (a loading direction of the sheet feeding cassette 2) indicated in FIG. 2. The front portion 12 is disposed at the arrow A' direction side (downstream side in a drawing direction), and constitutes a part of an exterior surface of the image forming apparatus. A handle portion 12*a* is formed in a lower right part of the front portion 12.

Figure 3:
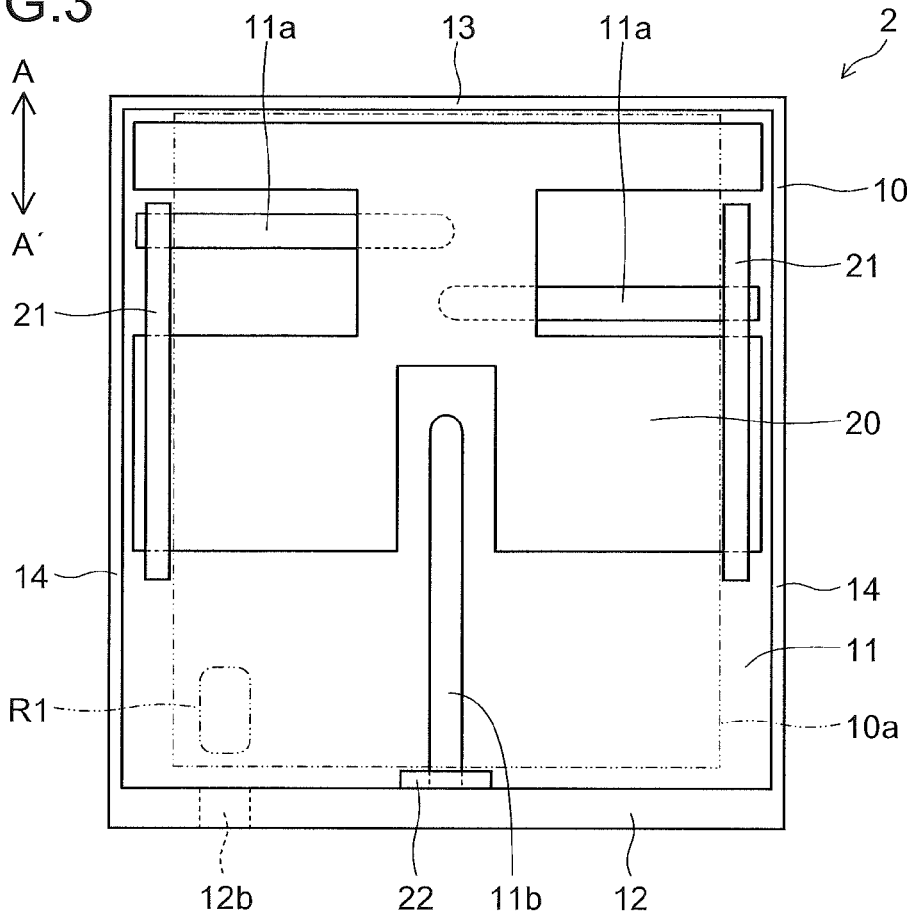
FIG. 3 is a plan view for describing the structure of the sheet feeding cassette of the first embodiment of the present disclosure.

As illustrated in FIG. 2 and FIG. 3, a sheet stacking plate 20 for stacking sheets thereon is provided on the bottom portion 11 of the cassette main body 10. A biasing member (not shown) such as a compression coil spring is disposed below the sheet stacking plate 20, and the sheet stacking plate 20 swings on an edge thereof on the arrow A' direction side as a fulcrum, and thus a downstream-side part of the sheet stacking plate 20 in a sheet feeding direction (a part of the sheet stacking plate 20 on the arrow A direction side) is made to move up and down. By the sheet stacking plate 20 moving up to a predetermined position, an uppermost sheet is taken out of the sheet feeding cassette 2 by the sheet feeding device, and conveyed to the image forming portion.

Inside the cassette main body 10, a pair of width regulation cursors 21 made of resin are provided to stand along the sheet feeding direction (the arrow A direction). The width regulation cursors 21 are moved from both sides in a sheet width direction, which is perpendicular to the sheet feeding direction, until they each abut one of two sides of a bundle of sheets in the sheet width direction, whereby width-direction positioning of sheets is performed. The width regulation cursors 21 are movable along a width regulation cursor moving groove 11*a* (not shown) formed in the bottom portion 11 of the cassette main body 10 so as to extend in the sheet width direction.

In a lower part of each of the width regulation cursors 21, there is provided a groove engagement portion (not shown), and engagement of the groove engagement portion in the width regulation cursor moving groove 11*a* prevents the width regulation cursors 21 from coming off from the cassette main body 10. Below the pair of width regulation cursors 21, each of which moves to abut one of the two sides of the bundle of sheets in the sheet width direction, there is provided an unillustrated interlocking mechanism that allows the width regulation cursors 21 to move in conjunction with each other such that when one of the width regulation cursors 21 is moved, the movement causes the other to move together. At this time, the pair of width regulation cursors 21 move symmetrically to each other with respect to a center line of the sheets in the sheet width direction.

Inside the cassette main body 10, a rear edge regulation cursor 22 made of resin is provided on an upstream side in the sheet feeding direction. The rear edge regulation cursor 22 is moved to abut one side of the bundle of sheets in the sheet feeding direction from the upstream side in the sheet feeding direction, whereby sheet-feeding-direction positioning of the sheets is performed. The rear edge regulation cursor is movable along a rear edge regulation cursor moving groove 11*b* (not shown) formed in the bottom portion 11 of the cassette main body 10 to extend in the sheet feeding direction. In a manner similar to that of the width regulation cursors 21, the rear edge regulation cursor 22 is prevented from coming off from the cassette main body 10 by engagement of an unillustrated groove engagement portion provided in a lower part of the rear edge regulation cursor 22 in the rear edge regulation cursor moving groove 11*b*.

An opening 12*b* is formed on one side (left side) of the front portion 12 of the cassette main body 10. The opening 12*b* is so positioned as to allow the user to see through the opening 12*b* a storage region 10*a* (see FIG. 3) in the cassette main body 10 on which the sheets are stored. In the present embodiment, the region that is visible through the opening 12*b* is a region R1 illustrated in FIG. 3, and the region does not include any region other than the storage region 10*a*. Here, "the region that is visible through the opening 12*b*" means a region that can be seen through the opening 12*b* when the sheet feeding cassette 2 is seen from the front and slightly above.

The cassette main body 10 (the bottom portion 11, the front portion 12, the back portion 13, and the pair of side portions 14) is formed in white or a pale color (such as cream) with a lightness of nine or more in Munsell value, for example.

Here, in the storage region 10*a*, at least a part of the visible region (the region R1) that is visible through the opening 12*b* is formed in a color that is different (lower) in lightness by three or more in Munsell value as compared with a light-color part of the bottom portion 11, the light-color part being formed in white or the pale color. In the present embodiment, the entire region R1 (in FIG. 4, a region R2 of the bottom portion 11) is colored with a deep color (for example, black, deep gray, deep blue, deep green, deep red, and deep brown) with a lightness of six or lower in Munsell value, such that the lightness of the region R1 is different (lower) by three or more in Munsell value as compared with the light-color part of the bottom portion 11 (in the bottom portion 11, regions except the region R2, regions with a lightness of nine or more).

Figure 4:
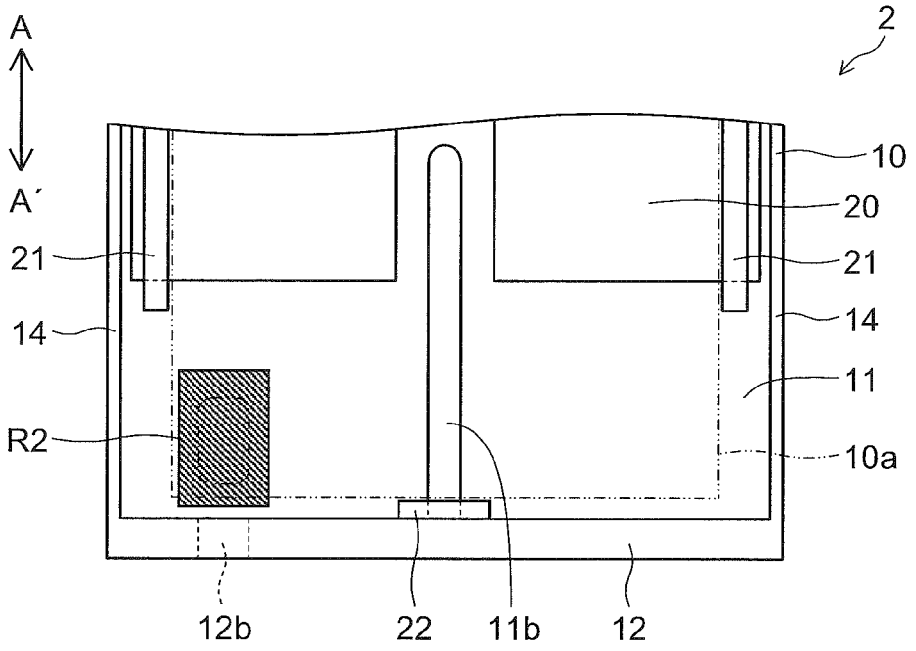
FIG. 4 is a plan view illustrating the structure of the sheet feeding cassette of the first embodiment of the present disclosure.
Figure 5:
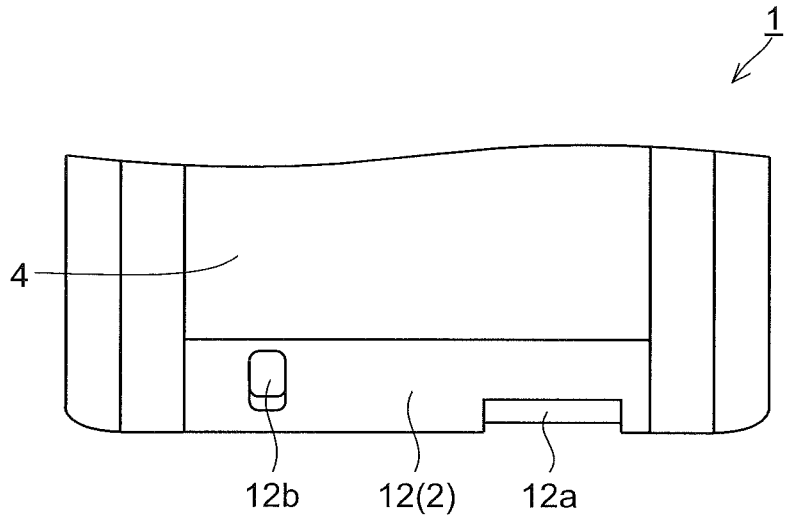
FIG. 5 is a diagram illustrating the sheet feeding cassette of the first embodiment of the present disclosure as seen from the front and slightly above, with a sheet stored in the sheet feeding cassette.
Figure 6:
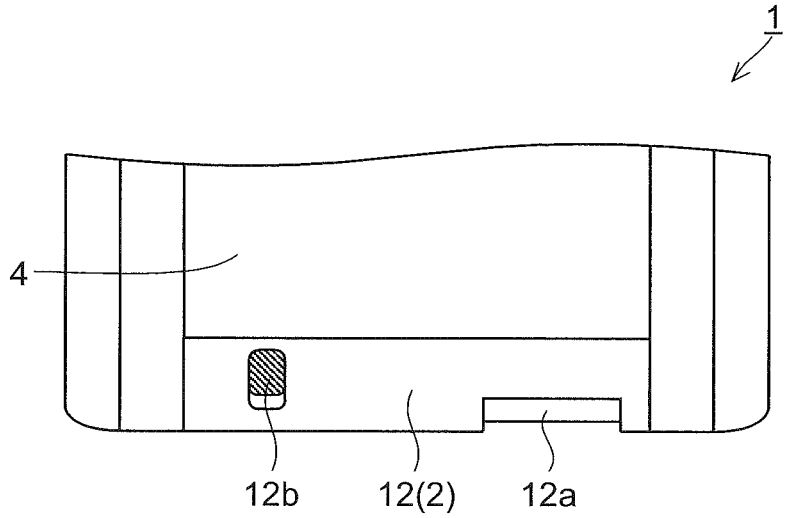
FIG. 6 is a diagram illustrating the sheet feeding cassette of the first embodiment of the present disclosure as seen from the front and slightly above, with no sheet left in the sheet feeding cassette.

As a result, with a white sheet stored in the sheet feeding cassette 2, as illustrated in FIG. 5, the sheet is visible through the opening 12*b*, and thus an inner part visible through the opening 12*b* appears to be whitish. On the other hand, with no sheet left in the sheet feeding cassette 2, as illustrated in FIG. 6, what is visible through the opening 12*b* is the part (the region R2) with the lower lightness, and thus the inner part visible through the opening 12*b* appears to be blackish (dark). This makes it possible for the user to correctly confirm the presence/absence of a sheet. In FIG. 4 and FIG. 6, and in FIGS. 7, 8, and 9 which will be referred to later, such regions as are colored with a deep color with a lightness of 6 or lower is indicated by hatching.

Adoptable as a method for forming only a part (the region R2) of the bottom portion 11 to be different in lightness from other parts is, for example, attaching (fitting, bonding, etc.) another member made of a material such as resin or paper to the bottom portion 11, or the cassette main body 10 may be formed by two-color molding using resins of two different colors.

In the present embodiment, as described above, in the storage region 10*a*, the visible region (the region R1) that is visible through the opening 12*b* provided in the front portion 12 is formed to be different (lower) in lightness by three of more in Munsell value as compared with the light-color part of the bottom portion 11. As a result, when sheets of paper in the sheet feeding cassette 2 have been used up, the part with a lower lightness (the region R2) becomes visible through the opening 12*b*. This makes it possible for the user to correctly confirm the presence/absence of a sheet even with the sheet feeding cassette 2 loaded in the apparatus main body 3.

Furthermore, unlike the conventional image forming apparatus described far above, the present embodiment does not require a two-color LED or a control portion, and thus allows correct confirmation of the presence/absence of a sheet with a simple configuration. Moreover, even when the power supply of the image forming apparatus 1 is off, it is possible to confirm the presence/absence of a sheet.

Figure 7:
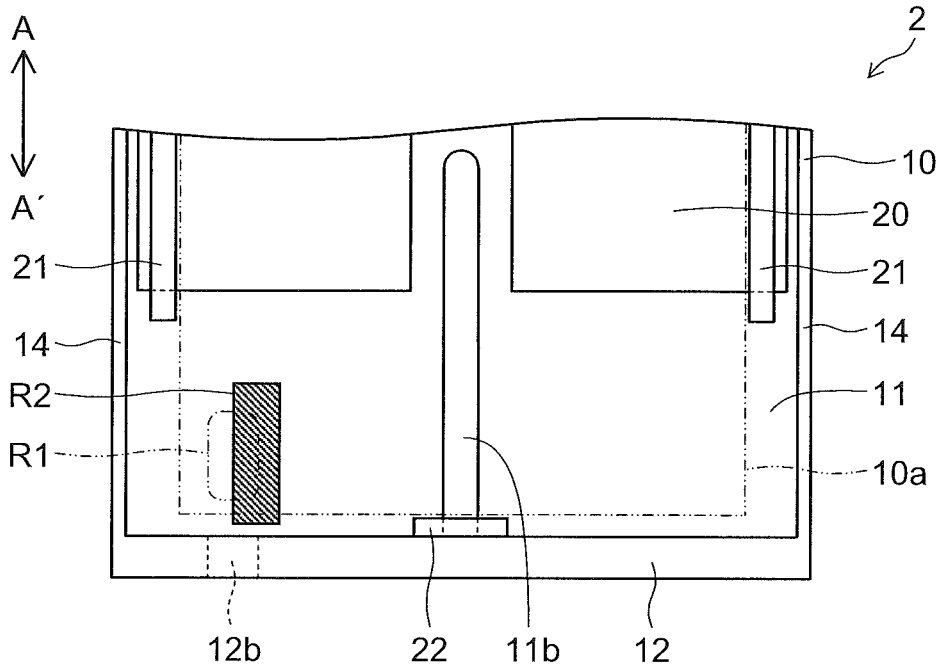
FIG. 7 is a plan view illustrating a structure of a sheet feeding cassette of a modified example of the first embodiment of the present disclosure.

As a modified example of the first embodiment, as illustrated in FIG. 7, the region R2, which is different in lightness by three or more in Munsell value from the light-color part of the bottom portion 11, may be formed small, to thereby make a part of the visible region (the region R1) different (lower) in lightness by three or more in Munsell value as compared with the light-color part of the bottom portion 11.

With this configuration, the light-color part and the deep-color part (the region R2) both become visible through the opening 12*b* when sheets of paper stored in the sheet feeding cassette 2 have been used up, and color contrast is enhanced between one part (the right side part) and the other part (the left side part) of the visible region (the region R1). This allows the user to confirm the presence/absence of a sheet more securely.

Next, a description will be given of confirmatory experiments conducted to confirm advantages of the present embodiment. The confirmatory experiments were conducted with respect to examples 1 and 2 corresponding to the above-discussed embodiments, and comparative examples 1 to 3.

Example 1

An sheet feeding cassette 2 colored entirely white was prepared, and a sheet of paper different (lower) in lightness by 3.5 in Munsell value as compared with the bottom portion 11 was bonded to the region R2 in the storage region 10*a*. Other configurations of Example 1 were similar to those of the above-discussed embodiment.

Example 2

A sheet of paper different (lower) in lightness by 3.0 in Munsell value as compared with the bottom portion 11 was bonded to the region R2 in the storage region 10*a*. Other structures of Example 2 were similar to those of Example 1.

Comparative Example 1

A sheet of paper different (lower) in lightness by 2.6 in Munsell value as compared with the bottom portion 11 was bonded to the region R2 in the storage region 10*a*. Other structures of Comparative Example 1 were similar to those of Example 1.

Comparative Example 2

A sheet of paper different (lower) in lightness by 2.1 in Munsell value as compared with the bottom portion 11 was bonded to the region R2 in the storage region 10*a*. Other structures of Comparative Example 2 were similar to those of Example 1.

Comparative Example 3

A sheet of paper different (lower) in lightness by 1.7 in Munsell value as compared with the bottom portion 11 was bonded to the region R2 in the storage region 10*a*. Other structures of Comparative Example 3 were similar to those of Example 1.

Then, with respect to Examples 1 and 2 and Comparative Examples 1 to 3, the presence/absence of a sheet was confirmed. Specifically, the image forming apparatus 1 was installed in a place with a brightness of about 500 lux, which is a brightness generally adopted in offices, and then a white sheet with a lightness of nine in Munsell value was placed in the sheet feeding cassette 2. Then, it was examined, with a plurality of examinees, whether or not each examinee was able to recognize the presence/absence of the sheet through the opening 12*b* after the sheet was removed from the storage cassette 2. Then, a recognition rate (the number of examinees whose recognition was correct/the total number of examinees) was calculated and evaluated. The results are indicated in Table 1 below, where "excellent" indicates a case where the recognition rate was 90% or higher, "good" indicates a case where the recognition rate was 70% or higher but lower than 90%, and "poor" indicates a case where the recognition rate was lower than 70%.

TABLE 1

| | Lightness Difference | Result (Recognition Rate) |
|---|---|---|
| Example 1 | 3.5 | Excellent (100%) |
| Example 2 | 3.0 | Excellent (100%) |
| Comparative Example 1 | 2.6 | Good (80%) |
| Comparative Example 2 | 2.1 | Good (70%) |
| Comparative Example 3 | 1.7 | Poor (60%) |

Table 1 shows that the user is able to correctly confirm the presence/absence of the sheet in the case where the visible region is formed to be different (lower) in lightness by 3.0 in Munsell value as compared with the bottom portion 11 which is colored white or a pale color.

Second Embodiment

Figure 8:
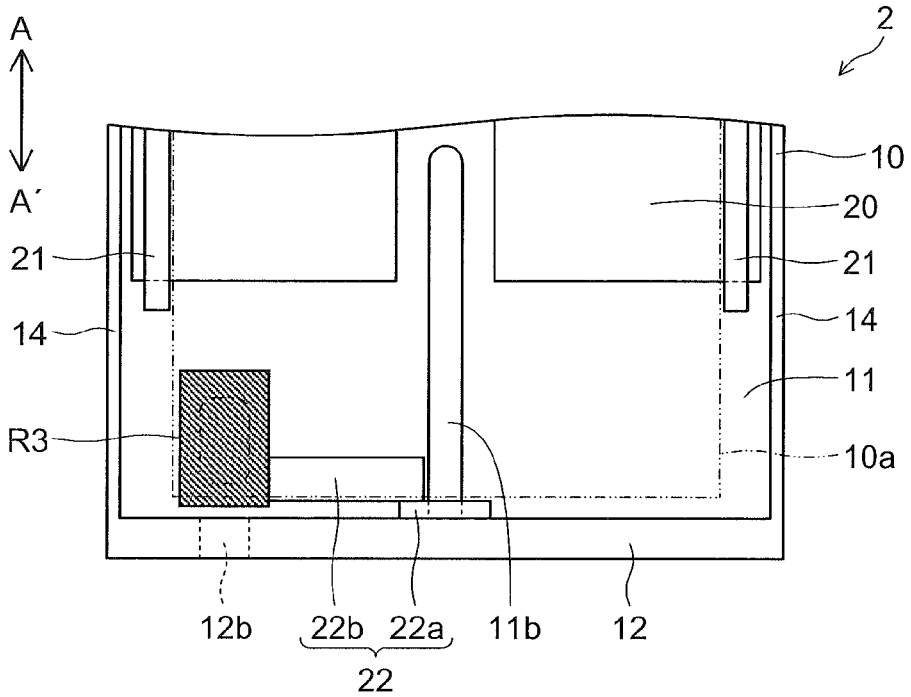
FIG. 8 is a plan view illustrating a structure of a sheet feeding cassette of a second embodiment of the present disclosure.

Next, with reference to FIG. 8, a description will be given of a sheet feeding cassette 2 of a second embodiment of the present disclosure. In the second embodiment of the present disclosure, as illustrated in FIG. 8, a rear edge regulation cursor (a visible member, a cursor) 22 has a main body portion 22*a* that abuts a rear edge of a sheet and an extension portion 22*b* that extends from the main body portion 22*a* toward a visible region (a region R1) along a bottom portion 11. The extension portion 22*b* has a region R3 formed to be able to cover the region R1 that is visible through an opening 12*b*. Furthermore, the region R3 of the extension portion 22*b* is colored with a deep color such that the lightness of the region R3 becomes six or lower in Munsell value, and thus the region R3 is different (lower) in lightness by three or more in Munsell value as compared with a light-color part of the bottom portion 11 (the entire bottom portion 11, a region with a lightness of nine or more in Munsell value).

Other structures of the second embodiment are similar to those of the first embodiment described above.

In the present embodiment, as described above, a part of the rear edge regulation cursor 22 is formed lower in lightness than the bottom portion 11 which is colored with white or a pale color, and this makes it possible to easily make the visible region (the region R1), which is visible through the opening 12*b* provided in the front portion 12, a region that is lower in lightness than the light-color part of the bottom portion 11.

The same advantages can be obtained by forming the entire rear edge regulation cursor 22 to be lower in lightness than the light-color part of the bottom portion 11.

Furthermore, as described above, the rear edge regulation cursor 22 is provided with the extension portion 22*b* extending from the main body portion 22*a* toward the visible region (the region R1), and the extension portion 22*b* is formed to be lower in lightness than the light-color part of the bottom portion 11. Thus, even in a case where the opening 12*b* is formed at a position (far) away from the main body portion 22*a* of the rear edge regulation cursor 22, the extension portion 22*b* can be extended to be disposed in the visible region (the region R1), and this makes it possible to position the opening 12*b* and the rear edge regulation cursor 22 with enhanced flexibility.

Other advantages of the second embodiment are similar to those of the first embodiment described above.

Figure 9:
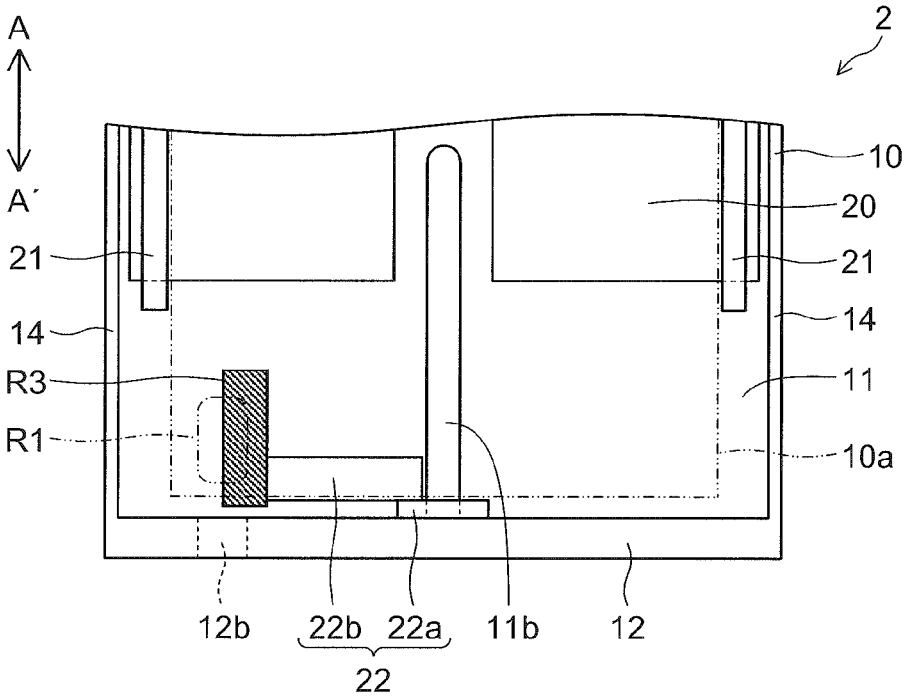
FIG. 9 is a plan view illustrating a structure of a sheet feeding cassette of a modified example of the second embodiment of the present disclosure.

As a modified example of the second embodiment, as illustrated in FIG. 9, in the extension portion 22*b*, the region R3, which is colored to have a lightness of six or lower, may be formed small such that a part of the visible region (the region R1) is different (lower) in lightness by three or more as compared with the light-color part of the bottom portion 11.

With this configuration, it is possible for the user to see both the bottom portion 11 in white or a pale color and the deep-colored region R3 of the extension portion 22*b* through the opening 12*b* when sheets in the sheet feeding cassette 2 have been used up, and to enhance color contrast between one part (the right side part) and the other part (the left side part) of the visible region (the region R1). This allows the user to confirm the presence/absence of a sheet more securely.

Third Embodiment

Figure 10:
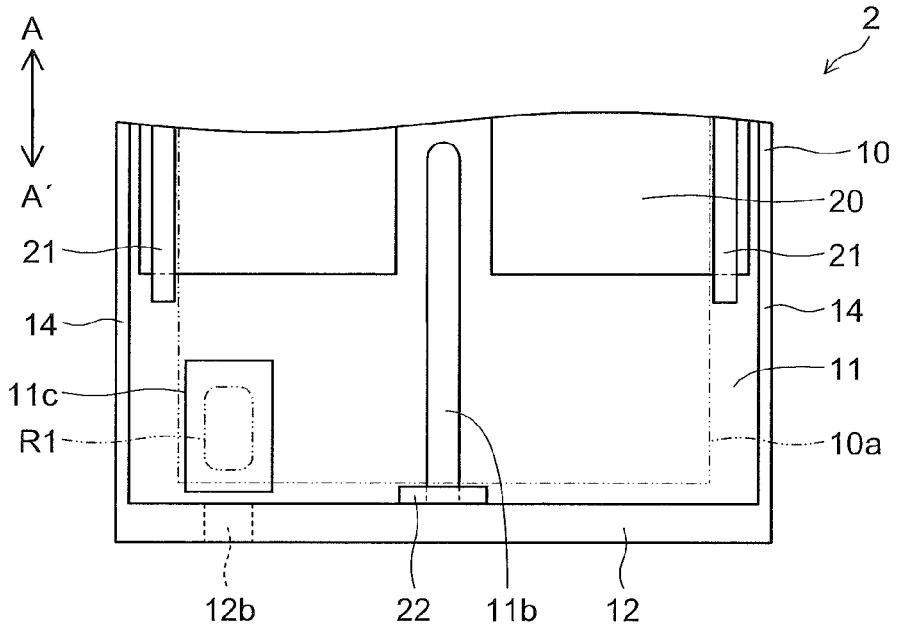
FIG. 10 is a plan view illustrating a structure of a sheet feeding cassette of a third embodiment of the present disclosure.

Next, with reference to FIG. 10, a description will be given of a sheet feeding cassette 2 of a third embodiment of the present disclosure. In the third embodiment of the present disclosure, as illustrated in FIG. 10, within a visible region in a storage region 10*a*, the visible region being visible through an opening 12*b*, a through hole 11*c* is formed in a bottom portion 11. The through hole 11*c* is formed to cover a region R1. Here, the formation of the through hole 11*c* makes, in the part where the through hole 11*c* is formed, a difference in level corresponding to the distance to a surface on which the image forming apparatus 1 is set, and this makes it difficult for light to reach the part, and thus makes the part shadowy. As a result, an inside of the through hole 11*c* appears to be darker than the other part of the bottom portion 11.

Other structures of the third embodiment are similar to those in the first embodiment described above.

In the present embodiment, as described above, within the visible region that is visible through the opening 12*b* of the front portion 12, the through hole 11*c* is formed in the bottom portion 11. As a result, the part where the through hole 11*c* is formed becomes dark, and thus, when sheets stored in the sheet feeding cassette 2 have been used up, a dark part (the part where the through hole 11*c* is formed) can be seen through the opening 12*b*. This allows the user to securely confirm the presence/absence of a sheet with the sheet feeding cassette 2 loaded in the apparatus main body 3.

Other advantages of the third embodiment are similar to those of the first embodiment described above.

Figure 11:
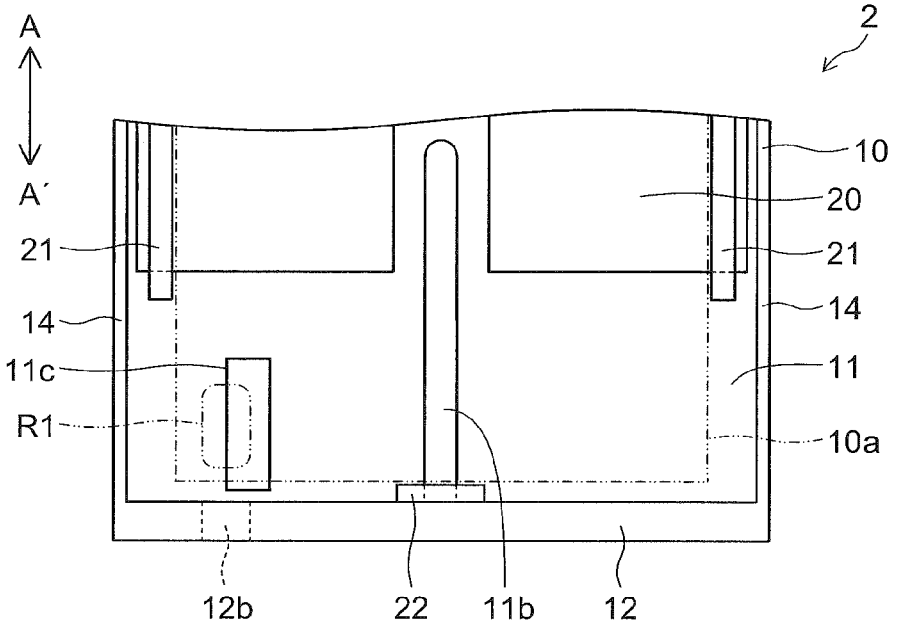
FIG. 11 is a plan view illustrating a structure of a sheet feeding cassette of a modified example of the third embodiment of the present disclosure.

As a modified example of the third embodiment, as illustrated in FIG. 11, a through hole 11*c* may be formed small, and the through hole 11*c* may be formed to cover a part of the bottom portion 11 within the visible region (the region R1).

With this configuration, when sheets in the sheet feeding cassette 2 have been used up, it is possible to see both the bottom portion 11 colored with white or a pale color and the dark part (the part where the through hole 11*c* is formed) through the opening 12*b*, and to enhance color contrast between one part (the right side part) and the other part (the left side part) of the visible region (the region R1). This allows the user to confirm the presence/absence of a sheet more securely.

Fourth Embodiment

Figure 12:
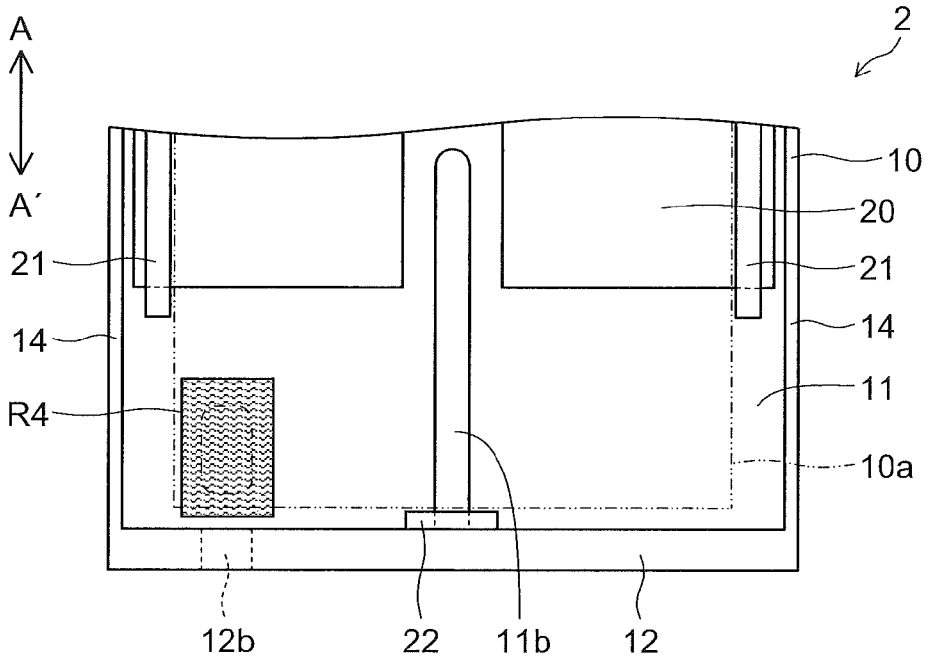
FIG. 12 is a plan view illustrating a structure of a sheet feeding cassette of a fourth embodiment of the present disclosure.

Next, with reference to FIG. 12, a description will be given of a sheet feeding cassette 2 of a fourth embodiment of the present disclosure. In the fourth embodiment of the present disclosure, as illustrated in FIG. 12, an entire visible region visible through the opening 12*b* (that is, in a bottom portion 11, a region R4 illustrated in FIG. 12) has a textured or knurled surface, so that minute irregularities are formed in the surface of the visible region. Thus, the region R4 with the textured or knurled surface reflects light in a different manner from the other part of the bottom portion 11 with a smooth surface, and as a result, the region R4 appears to be darker than the other part of the bottom portion 11.

Other structures of the fourth embodiment are similar to those in the first embodiment described above.

In the present embodiment, as described above, the visible region (the region R1) that is visible through the opening 12*b* of the front portion 12 has a textured or knurled surface. As a result, the region R4 with the textured or knurled surface appears to be dark, and thus, when sheets in the sheet feeding cassette 2 have been used up, the dark part (the region R4 with the textured or knurled surface) can be seen through the opening 12*b*. This allows the user to securely confirm the presence/absence of a sheet even with the sheet feeding cassette 2 loaded in the apparatus main body 3.

Here, instead of the bottom portion 11, a part of (or the whole of) a rear edge regulation cursor 22 may have a textured or knurled surface, in the same manner as in the second embodiment described above.

Other advantages of the fourth embodiment are similar to those of the first embodiment described above.

Figure 13:
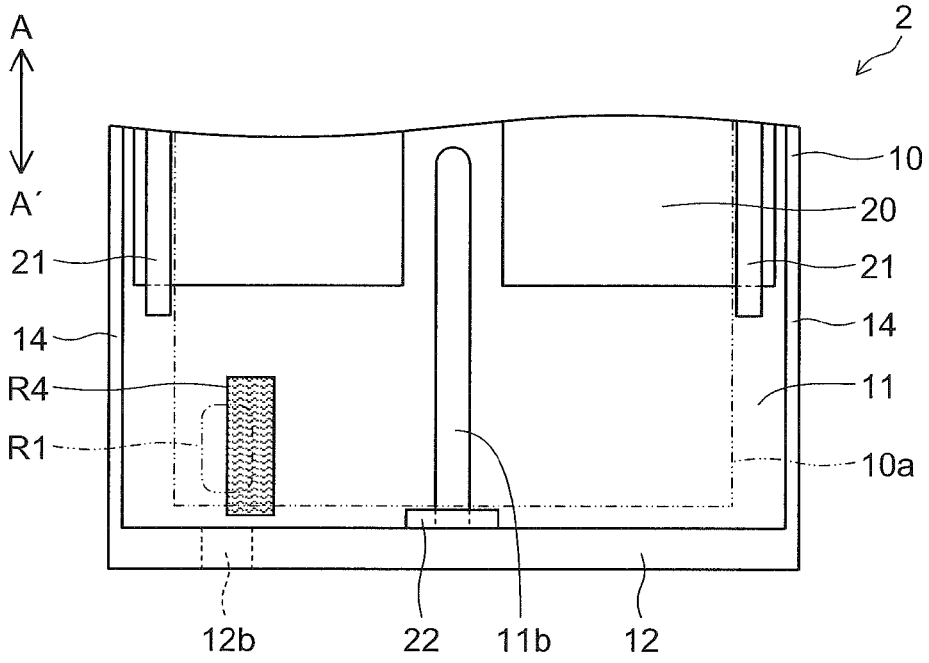
FIG. 13 is a plan view illustrating a structure of a sheet feeding cassette of a modified example of the fourth embodiment of the present disclosure.

As a modified example of the fourth embodiment, as illustrated in FIG. 13, the region R4 with the textured or knurled surface may be formed small, and a part of the visible region (the region R1) may have a textured or knurled surface.

With this configuration, when sheets in the sheet feeding cassette 2 have been used up, it is possible to see both a light-color part (the bottom portion 11 except the region R4) and a dark part (the region R4 with the textured or knurled surface) through the opening 12*b*, and to enhance color contrast between one part (the right side part) and the other part (the left side part) of the visible region (the region R1). This allows the user to confirm the presence/absence of sheets of paper more securely.

Fifth Embodiment

Figure 14:
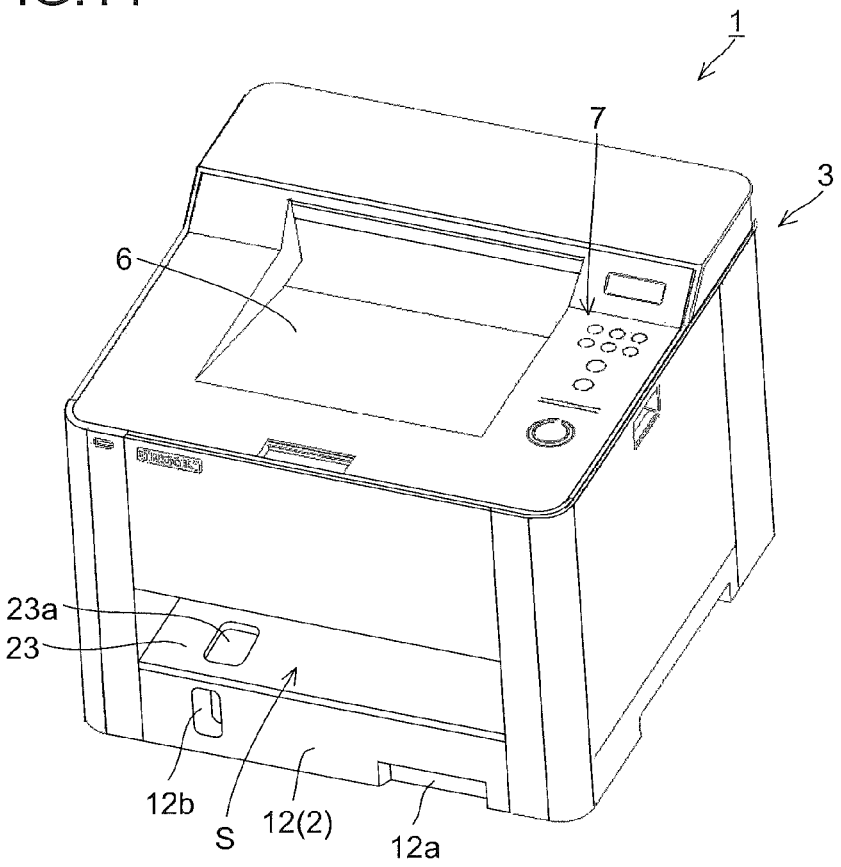
FIG. 14 is a perspective view illustrating a structure of an image forming apparatus including a sheet feeding cassette of a fifth embodiment of the present disclosure.

Next, with reference to FIG. 14 and FIG. 15, a description will now be given of an image forming apparatus 1 including a sheet feeding cassette 2 according to a fifth embodiment of the present disclosure. In a forward portion of the apparatus main body 3, which a user is to stand facing when using the image forming apparatus 1, there is provided a space S above the sheet feeding cassette 2.

Figure 15:
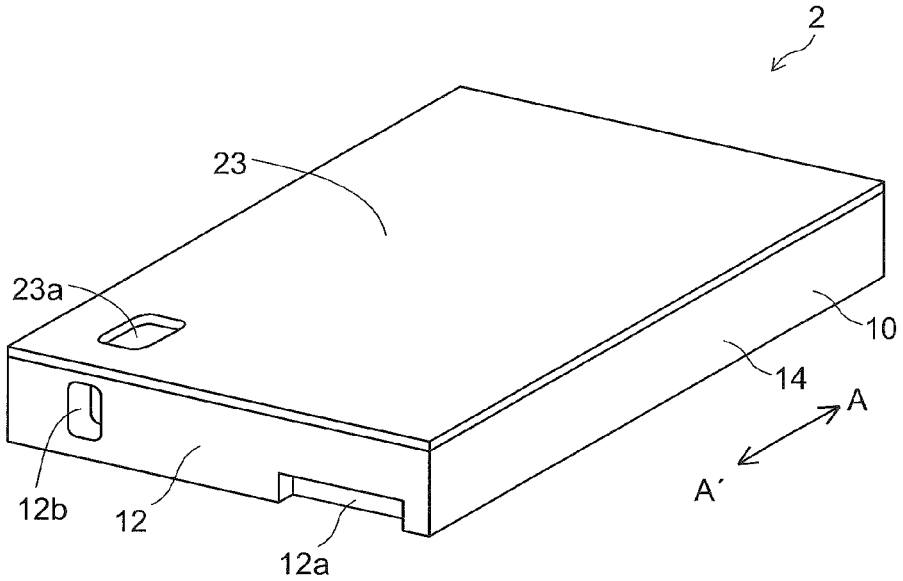
FIG. 15 is a perspective view illustrating a structure of the sheet feeding cassette of the fifth embodiment of the present disclosure.

As illustrated in FIG. 15, the sheet feeding cassette 2 includes a cassette cover (a cover member) 23 that covers an upper part of a cassette main body 10. In the cassette cover 23, there is formed a lighting window 23*a* through which light enters an inside of an opening 12*b* (a storage region 10*a*). This makes it possible for light to enter the inside of the opening 12*b* through the lighting window 23*a* even during an image forming operation.

Other structures of the fourth embodiment are similar to those in the second to fourth embodiments described above.

In the present embodiment, as described above, the lighting window 23*a* is provided in the cassette cover 23 to allow light to enter the inside of the opening 12*b*. This makes it possible, when a sheet is present inside the sheet feeding cassette 2, to prevent the sheet from appearing to be blackish when seen through the opening 12*b*, and thus to prevent a user from erroneously judging that there is no sheet left when there actually exists a sheet in the sheet feeding cassette 2.

Other advantages of the fifth embodiment are similar to those in the second to fourth embodiments described above.

As a modified example of the fifth embodiment, instead of providing the lighting window 23*a* in the cover member 23, the cover member 23 may be formed of a transparent or translucent member.

In this case, too, it is possible to allow light to enter the inside of the opening 12*b*, and prevent a sheet existing in the sheet feeding cassette 2 from appearing to be blackish when seen through the opening 12*b*, and thus, it is possible to prevent the user from erroneously judging that there is no sheet left when there actually exist a sheet in the sheet feeding cassette 2.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications in the meaning and range equivalent to the scope of claims for patent are included.

For example, although the above-described embodiments have dealt with an image forming apparatus using an electro-photographic system as an example, this is not meant as a limitation, and the present disclosure is applicable to image forming apparatuses employing other image forming systems such as an inkjet system, thermal transfer system, etc., and furthermore, the present disclosure is widely applicable also to apparatuses that simply convey sheets, apparatuses that perform post-processing to sheets or the like on which images have been formed.

Moreover, although the above-described embodiments have dealt with examples where the region R1 visible through the opening 12*b* does not include any region out of the storage region 10*a*, the region R1 may instead include the storage region 10*a* and other regions (regions around the storage region 10*a*).

Furthermore, although the above-described first and second embodiments, for example, have dealt with cases where the region (the regions R2 and R3) that is different in lightness by three or more in Munsell value from the light-color part of the bottom portion 11 is rectangular shaped, but this is not meant to limit the present disclosure. For example, the region may be so colored as to appear to be a letter, a sign, or a striped pattern.

For example, although the above-described fifth embodiment has dealt with an example where a cover member (the cassette cover 23) that covers the upper part of the cassette main body 10 of the sheet feeding cassette 2 is provided as a part of the sheet feeding cassette 2, but this is not meant to limit the present disclosure. Instead, a cover member which covers an upper part of the sheet feeding cassette 2 may be provided integral with the apparatus main body 3. In this case, for example, in the apparatus main body 3 of the above-described first embodiment, a lighting window may be provided in a paper conveyance face (not shown) provided inside the front cover 4. When providing a lighting window in the paper conveyance face, the lighting window is disposed outside a sheet conveyance region. Also, the sheet conveyance surface provided inside the front cover 4 may be formed of a transparent or translucent member.

It should be understood that configurations obtained by appropriately combining the configurations of the foregoing embodiments and modified examples are also included in the scope of the present disclosure.

What is claimed is:

1. An image forming apparatus comprising:

an apparatus main body;

a sheet feeding cassette insertable and drawable with respect to the apparatus main body; and a cover member that covers an upper part of the sheet feeding cassette, wherein the sheet feeding cassette comprises:

a storage region on which a sheet is stored;

a front portion that is disposed on a downstream side with respect to the storage region in a drawing direction, and that constitutes a part of an exterior surface of the image forming apparatus; and a bottom portion on which the sheet is placed, in a forward portion of the apparatus main body, a space is provided between the apparatus main body and the sheet feeding cassette, the cover member faces the space above the sheet feeding cassette, the front portion is disposed so as not to protrude beyond the forward portion, the front portion includes an opening through which the storage region is visible, the front portion is formed in a white or a pale color, within the storage region, the bottom portion is formed in the white or the pale color, at least a part of a visible region in the storage region, the visible region being visible through the opening, or at least a part of a visible member disposed on the visible region, is formed to be different in lightness by three or more in Munsell value from a light-color part of the bottom portion, the light-color part being formed in white or the pale color, the cover member has a lighting window through which light is allowed to enter an inside of the opening, or the cover member is formed of a transparent or translucent member, and during an image forming operation, light is allowed to enter the inside of the opening through the lighting window or the transparent or translucent member.

2. The image forming apparatus according to claim 1, wherein within the visible region, at least a part of the bottom portion is formed to be different in lightness by three or more in Munsell value from the light-color part.

3. The image forming apparatus according to claim 1, wherein the visible member is a cursor that adjusts a position of an edge of the sheet, and at least a part of the cursor is formed to be different in lightness by three or more in Munsell value from the light-color part.

4. The image forming apparatus according to claim 3, wherein the cursor has a main body portion that abuts the edge of the sheet, and an extension portion that extends toward the visible region from the main body portion, and at least a part of the extension portion is formed to be different in lightness by three or more in Munsell value from the light-color part.

5. The image forming apparatus according to claim 1, wherein a part of the visible region or a part of the visible member is formed to be different in lightness by three or more in Munsell value from the light-color part.

6. The image forming apparatus according to claim 1, wherein the front portion and the bottom portion are formed integral with each other.

7. The image forming apparatus according to claim 1, wherein the cover member is provided to the apparatus main body.

8. An image forming apparatus comprising:

an apparatus main body;

a sheet feeding cassette insertable and drawable with respect to the apparatus main body; and a cover member that covers an upper part of the sheet feeding cassette, wherein the sheet feeding cassette comprises:

a storage region on which a sheet is stored;

a front portion that is disposed on a downstream side with respect to the storage region in a drawing direction, and that constitutes a part of an exterior surface of the image forming apparatus; and a bottom portion on which the sheet is placed, in a forward portion of the apparatus main body, a space is provided between the apparatus main body and the sheet feeding cassette, the cover member faces the space above the sheet feeding cassette, the front portion is disposed so as not to protrude beyond the forward portion, the front portion includes an opening through which the storage region is visible, the front portion is formed in a white or a pale color, within the storage region, the bottom portion is formed in the white or the pale color, within a visible region in the storage region, the visible region being visible through the opening, a through hole is formed at least in a part of the bottom portion, the cover member has a lighting window through which light is allowed to enter an inside of the opening, or the cover member is formed of a transparent or translucent member, and during an image forming operation, light is allowed to enter the inside of the opening through the lighting window or through the transparent or translucent member.

9. The image forming apparatus according to claim 8, wherein within the visible region, the through hole is formed in a part of the bottom portion.

10. The image forming apparatus according to claim 8, wherein the front portion and the bottom portion are formed integral with each other.

11. The image forming apparatus according to claim 8, wherein the cover member is provided to the apparatus main body.

12. An image forming apparatus comprising:

an apparatus main body;

a sheet feeding cassette insertable and drawable with respect to the apparatus main body; and a cover member that covers an upper part of the sheet feeding cassette, wherein the sheet feeding cassette comprises:

a storage region on which a sheet is stored;

a front portion that is disposed on a downstream side with respect to the storage region in a drawing direction, and that constitutes a part of an exterior surface of the image forming apparatus; and a bottom portion on which the sheet is placed, in a forward portion of the apparatus main body, a space is provided between the apparatus main body and the sheet feeding cassette, the cover member faces the space above the sheet feeding cassette, the front portion is disposed so as not to protrude beyond the forward portion, the front portion includes an opening through which the storage region is visible, the front portion is formed in a white or a pale color, within the storage region, the bottom portion is formed in the white or the pale color, texturing or knurling has been applied to at least a part of a visible region in the storage region or at least a part of a visible member disposed on the visible region, the visible region being visible through the opening, the cover member has a lighting window through which light is allowed to enter an inside of the opening, or the cover member is formed of a transparent or translucent member, and during an image forming operation, light is allowed to enter the inside of the opening through the lighting window or through the transparent or translucent member.

13. The image forming apparatus according to claim 12, wherein within the visible region, the texturing or the knurling has been applied to at least a part of the bottom portion.

14. The image forming apparatus according to claim 12, wherein the front portion and the bottom portion are formed integral with each other.

15. The image forming apparatus according to claim 12, wherein the cover member is provided to the apparatus main body.

* * * * *